United States Patent [19]

Barnes

[11] 4,139,990

[45] Feb. 20, 1979

[54] FLUID PULSATION AND TRANSIENT ATTENUATOR

[76] Inventor: Douglas R. Barnes, 1464 Hilltop Rd., Xenia, Ohio 45385

[21] Appl. No.: 896,830

[22] Filed: Apr. 17, 1978

Related U.S. Application Data

[62] Division of Ser. No. 780,955, Mar. 24, 1977.

[51] Int. Cl.[2] ..... F25B 9/02; F15C 1/16

[52] U.S. Cl. ..... 62/5; 137/812

[58] Field of Search ..... 62/5; 137/809, 810, 137/812

[56] References Cited

U.S. PATENT DOCUMENTS

| | | | |
|---|---|---|---|
| 2,893,432 | 7/1959 | Gibson | 62/5 |
| 3,214,923 | 11/1965 | Palmisano et al. | 62/5 |
| 3,216,439 | 11/1965 | Manion | 137/810 |
| 3,461,897 | 8/1969 | Kwok | 137/809 |
| 3,474,670 | 10/1969 | Rupert | 137/812 |
| 3,536,085 | 10/1970 | Taplin | 137/809 |
| 3,608,571 | 9/1971 | Wilcox | 137/809 |
| 3,722,522 | 3/1973 | Randall | 137/812 |
| 3,756,285 | 9/1973 | Johnson | 137/810 |
| 3,775,988 | 12/1973 | Fekete | 62/5 |
| 3,815,379 | 6/1974 | Inglis | 62/5 |

*Primary Examiner*—Lloyd L. King

*Attorney, Agent, or Firm*—Joseph E. Rusz; Richard J. Killoren

[57] ABSTRACT

An attenuator, for use in a fluid system for reducing pulsations and transients, having a vortex chamber with a plurality of tangential inlets and one or more outlets with converging nozzles being provided in the inlets to increase the inlet flow velocity and to provide diode action. At least one elbow is provided in the outlet line adjacent the vortex chamber outlet with a second elbow being provided at a distance from the elbow adjacent the vortex outlet, approximately equal to the radius of the vortex chamber. The second elbow is not needed when outlet line discharges to a sump or to the atmosphere.

2 Claims, 9 Drawing Figures

FLUID PULSATION AND TRANSIENT ATTENUATOR

RIGHTS OF THE GOVERNMENT

The invention described herein may be manufactured and used by or for the Government of the United States for all governmental purposes without the payment of any royalty.

This is a division of application Ser. No. 780,955, filed March 24, 1977.

BACKGROUND OF THE INVENTION

This invention relates to an attenuator for fluid pulsations and transients in fluid lines. The patents to Kwok, U.S. Pat. No. 3,461,897; Wilcox, U.S. Pat. No. 3,608,571; Randall, U.S. Pat. No. 3,722,522; and Johnson et al, U.S. Pat. No. 3,756,285 show vortex chambers used in various type apparatus.

Contraction and expansion waves in gas and liquid systems, sometimes referred to as water hammer or hydraulic hammer in liquid systems, reduce the efficiency and performance of the system and induce fatigue in the fluid system components, such as pumps, compressors and valves.

Resonators and surge tanks have been used in the past but have not been universally acceptable. While resonators provide acceptable results for fixed speeds and fixed flow, efficiency and performance suffers during widely varying speed and flow conditions. Surge tanks can be used only when space and weight requirements are not critical.

BRIEF SUMMARY OF THE INVENTION

According to this invention, fluid expansion and contraction waves and transients in fluid lines are attenuated by diode action in the nozzle inlet to a vortex chamber, wherein fluid pulsations and transients are further attenuated by frictional drag between fluid layers and between the fluid and the vortex chamber side walls. The vortex chamber is provided with a plurality of inlet nozzles around the periphery of the vortex chamber so that several devices, such as pumps or compressors, can be connected to a single attenuator unit without cross coupling of fluid pulsations.

An outlet from the center of the vortex chamber has a single elbow with a length of conduit approximately equal to the radius of the vortex extending to the edge of the vortex chamber. A second elbow is provided in the outlet near the edge of the vortex chamber if additional conduit is connected to the outlet line. The second elbow is not needed if the outlet discharges to a sump or the atmosphere.

IN THE DRAWINGS

Figure 1:
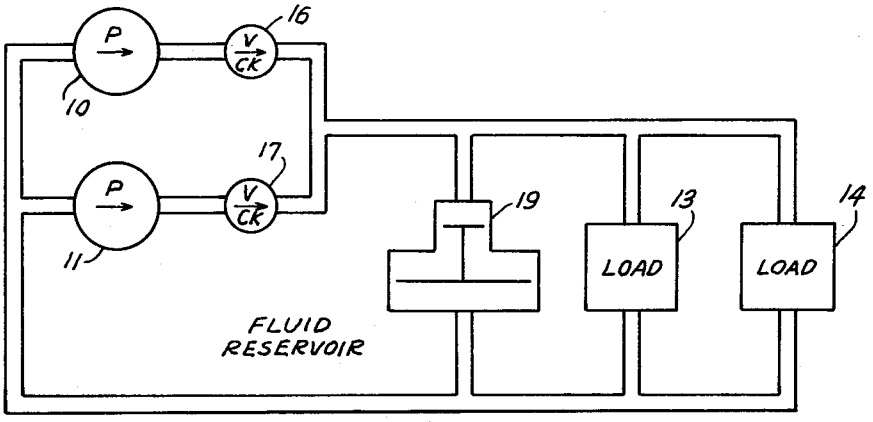
Fig. 1 PRIOR ART
FIG. 1 shows a prior art hydraulic system.

Reference is now made to FIG. 1 of the drawing to a conventional hydraulic system wherein two pumps 10 and 11 are used to supply loads 13 and 14. Conventional check valves 16 and 17 are provided to prevent reverse flow through pumps 10 and 11 should one become inoperative. A conventional fluid reservoir 19 is provided to maintain pressure in the fluid return line.

Figure 4:
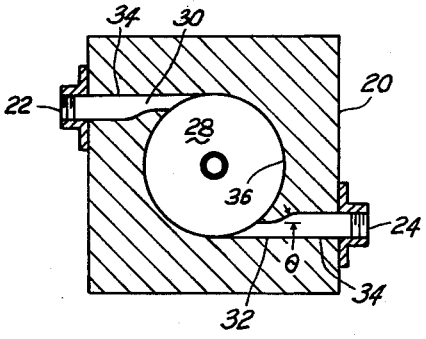
FIG. 4 is a sectional view of the device of FIG. 3 along the line 4—4.
Figure 3:
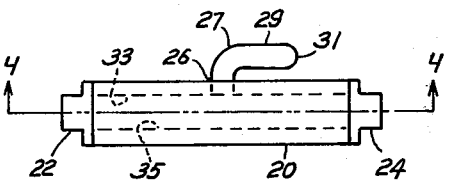
FIG. 3 shows the attenuator used in the device of FIG. 2.

To damp out fluid pulsations and transients in the system of FIG. 1, an attenuator 20 is provided between the pumps 10 and 11 and the loads 13 and 14. The construction of the attenuator 20, having inlets 22 and 24 and an outlet 26, is shown in greater detail in FIGS. 3 and 4.

The attenuator 20 includes a vortex chamber 28 with converging nozzles 30 and 32 being provided in the inlets 22 and 24. The converging nozzles 30 and 32 provide two functions. They act to accelerate the inlet flow, without turbulence, to create an ejector action in the vortex cavity 28. This increases the length of the rotational path from the inlet to the outlet and provides a greater attenuation of pulsations by frictional drag of the fluid on the surfaces of the cavity and between rotating layers of fluid. The nozzles also provide diode action since the nozzles are divergent nozzles, for reverse flow, which induce turbulence and a reverse pressure drop which is greater than the forward flow pressure drop. It was found that the angle $\theta$, shown in FIG. 4, should be between 16 and 24 degrees. To provide a smooth transition from the nozzle to the chamber, the walls 34 of the nozzle are tangential to the vortex chamber and the circular wall 36 should be smooth. However, the side walls 33 and 35 of the vortex chamber need not be smooth, as increased frictional drag along these walls will help to attenuate the pulsations in the flow.

It was found that increased attenuation of pulsations in the flow was obtained when an elbow 27 was provided in the exit line 29 adjacent to the vortex chamber outlet 26 with a second elbow 31 being provided at a distance approximately equal to the radius of the vortex chamber. It was found that when a length of conduit, approximately equal to the radius of the vortex chamber, which discharged into a sump or to the atmosphere was used, the second elbow was not needed.

Figure 2:
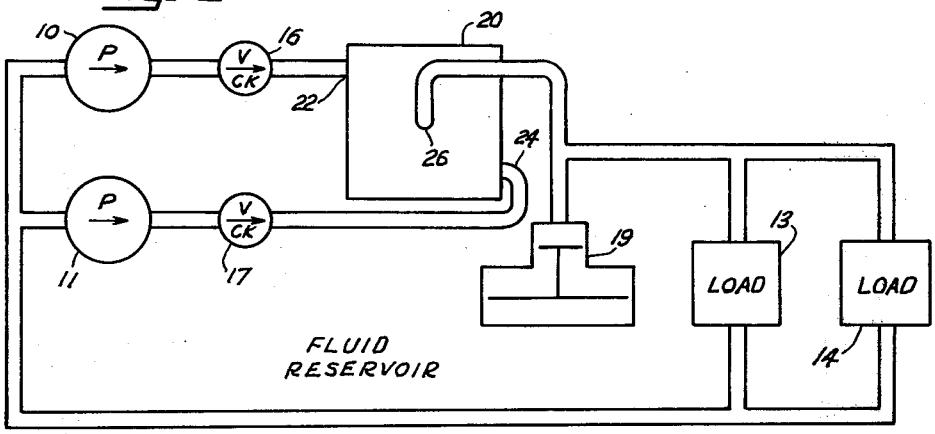
FIG. 2 shows the device of FIG. 1, modified according to this invention.

The device of the invention, as used in the device of FIG. 2, in addition to attenuating pulsations and transients, was found to reduce interactions in the parallel operated pumps.

Figure 5:
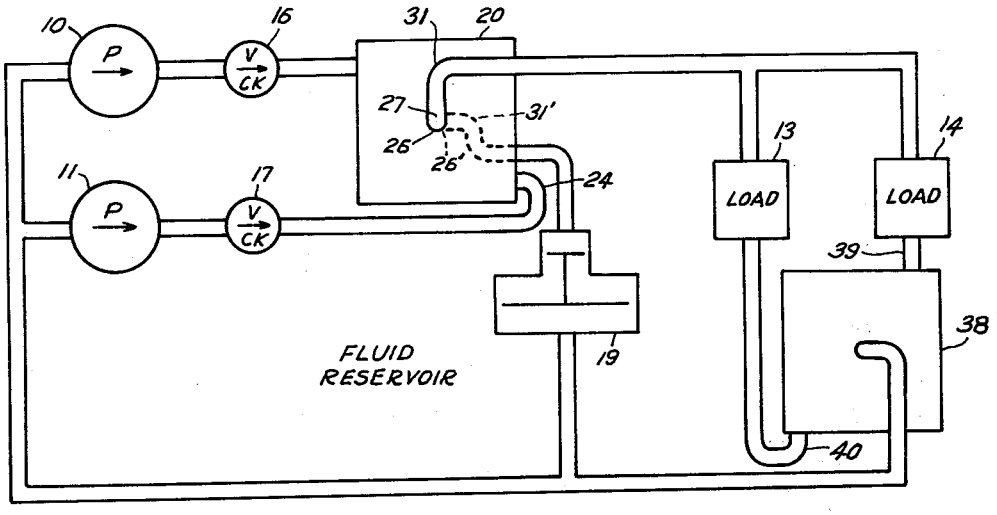
FIG. 5 shows a modification of the device of FIG. 2.
Figure 6:
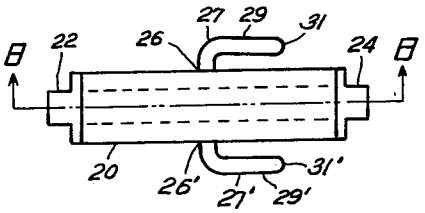
FIG. 6 shows another embodiment of the device shown in FIGS. 3 and 4.

While FIG. 2 shows a single attenuator, additional attenuators could be used in fluid systems. For example, as shown in FIG. 5 wherein a second attenuator 38, having inlets 39 and 40 and outlet 41, is provided between loads 13 and 14 and the input to pumps 10 and 11. Also though the fluid reservoir 19 in FIG. 2 is shown connected to outlet 26, a separate outlet 26′ could be provided in the attentuator as shown in FIGS. 5 and 6, with the pressurizing cylinder of the fluid reservoir 19 being connected to the second outlet.

Figure 7:
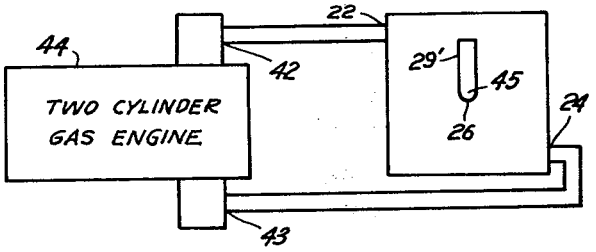
FIG. 7 shows a modification of the device of FIGS. 3 and 4 used with a two cylinder gas engine.

In FIG. 7 the inlets 22 and 24 of the attenuator of the invention are shown connected to the exhaust outlets 42 and 43 of a two cylinder gas engine 44. The exhaust outlet 26 in this device had a single elbow at 45 with the length of the outlet tube 29′ being approximately equal to the radius of the vortex chamber. With tube 29′ exhausting to the atmosphere, the second elbow was found to be unnecessary. In this system in addition to providing a muffler action, the attenuator was found to smooth the speed-torque curve for the engine.

Figure 8:
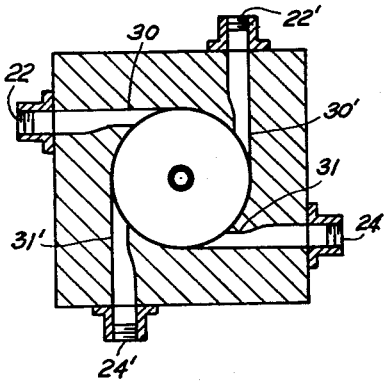
FIG. 8 shows another modification of the device of FIGS. 3 and 4.

While the devices thus far described show only two inlet nozzles, additional inlet nozzles such as 30' and 31' can be provided in inlets 22' and 24', as shown in FIG. 8, which may be needed for use with additional pumps or loads. For example, the device of FIG. 8 might be used with a four cylinder engine. In larger attenuators more inlets may be provided.

Figure 9:
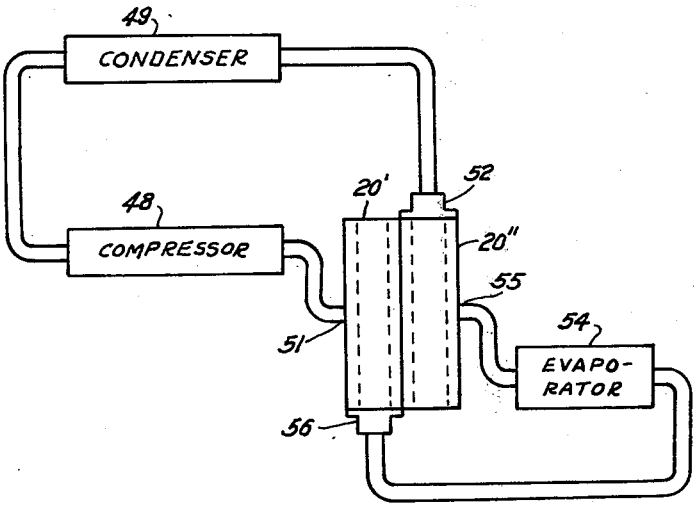
FIG. 9 shows another modification of the device of FIGS. 3 and 4 used in a refrigeration system.

Also two of the attenuators 20' and 20'' could be connected together, as shown in FIG. 9, wherein the compressor 48 and the condensor 49 of a refrigeration system are connected between the outlet 51 of attenuator 20' and the inlet 52 of attenuator 20'' with the evaporator 54 being connected between the outlet 55 of attenuator 20'' and the inlet 56 of attenuator 20'. Though only one inlet is shown in the attenuators 20' and 20'', if additional inlets were provided, the unused inlets could be capped when not in use. In the device of FIG. 9, the wall between attenuators 20' and 20'' could be designed to provide good heat exchange properties.

There is thus provided an attenuator for fluid pulsations and transients in fluid systems which increases the effiency and performance of the system and reduces the induced fatigue in the fluid system components.

I claim:

1. A fluid system contraction and expansion wave attenuator, comprising: means, including a cylindrical wall and two side walls, for forming a vortex chamber; at least one inlet means, for directing a flow of fluid into said vortex chamber tangential to the cylindrical wall; means for providing diode action in said inlet; said means for providing diode action, including means for increasing the velocity flow into said vortex chamber; a vortex chamber outlet, in one of said side walls, coaxial with the cylindrical wall; an outlet conduit connected to said vortex chamber outlet; said outlet conduit including means for attenuating pulsations and transients in the fluid flow through the outlet conduit; a second cylindrical wall, one of said side walls and an additional wall, for forming a second vortex chamber; at least one inlet means for directing a flow of fluid into said second vortex chamber tangential to the second cylindrical wall; means for providing diode action in the inlet to said second vortex chamber; said means providing diode action in the inlet to the second vortex chamber including means for increasing the velocity flow into said second vortex chamber; a second vortex chamber outlet, in said additional wall, coaxial with the second cylindrical wall; a refrigerator evaporator connected between the outlet of one of said vortex chambers and an inlet of the other vortex chamber and a compressor and condensor connected in series between the outlet of the other vortex chamber and an inlet of said one of said vortex chambers.

2. The device as recited in claim 1 wherein said means for providing diode action comprises a converging nozzle in the inlet adjacent the vortex chamber.

* * * * *